United States Patent [19]

Wotowiec

[11] 4,244,013

[45] Jan. 6, 1981

[54] CIRCULAR FLUORESCENT LIGHT UNIT

[75] Inventor: Joseph P. Wotowiec, Cuyahoga Falls, Ohio

[73] Assignee: General Electric Company, Schenectady, N.Y.

[21] Appl. No.: 944,650

[22] Filed: Sep. 21, 1978

[51] Int. Cl.[3] ..... F21S 5/00

[52] U.S. Cl. ..... 362/216; 362/260

[58] Field of Search ..... 362/216–225, 362/260

[56] References Cited

U.S. PATENT DOCUMENTS

| | | | |
|---|---|---|---|
| 2,350,462 | 6/1944 | Johns . | |
| 2,472,597 | 6/1949 | Levy | 362/216 |
| 2,480,301 | 8/1949 | Moretz | 362/216 |
| 2,507,074 | 5/1950 | Wiedenhoeft . | |
| 2,534,955 | 12/1950 | Dazley . | |
| 2,575,486 | 11/1951 | Branders | 362/216 |
| 2,943,238 | 6/1960 | Reaves | 362/216 |
| 3,039,678 | 6/1962 | Sharpe | 362/216 |
| 3,148,836 | 9/1964 | Potye . | |
| 3,742,208 | 6/1973 | Mills . | |
| 4,161,020 | 7/1979 | Miller | 362/225 |

FOREIGN PATENT DOCUMENTS

| | | | |
|---|---|---|---|
| 1956900 | 5/1971 | Fed. Rep. of Germany | 362/216 |

*Primary Examiner*—Harold J. Tudor
*Attorney, Agent, or Firm*—Norman C. Fulmer; Lawrence R. Kempton

[57] ABSTRACT

A screw-in circular fluorescent light unit having a circular light source, a hub having a screw-in base at the axis of the annular light source, and a plurality of symmetrically arranged support spokes extending radially from the hub to the circular light source. The support spokes are positioned and dimensioned so that the unit provides uniform illumination over the surface of a lamp shade.

7 Claims, 3 Drawing Figures

CIRCULAR FLUORESCENT LIGHT UNIT

BACKGROUND OF THE INVENTION

The invention is in the field of circular tubular (annular) fluorescent light units, such as screw-in units for use in lamps having shades, eg. floor lamps and table lamps.

Various ways have been devised for mounting circular fluorescent lights in floor lamps and table lamps. For example, U.S. Pat. No. 3,742,208 to Mills discloses a screw-in circular fluorescent light unit which includes a ballast or transformer in the unit, and the following U.S. patents disclose non-screw-in circular fluorescent lamps in shade-type lamps: U.S. Pat. Nos. 2,350,462 to Johns; 2,450,302 to Rowe; 2,507,074 to Wiedenhoeft; 2,534,955 to Dazley; and 3,148,836 to Potye.

In the above-referenced patents, the circular lamps lie in a horizontal plane, and are surrounded by a lamp shade. Many such lamp shades are translucent, so as to shade direct glare of the light source, and at the same time to transmit or radiate a certain amount of the light for a pleasing appearance and to somewhat illuminate the surroundings. Due to the circular configuration of the light source, it can cause bands of unequal brightness to occur on the shade. These unequal brightness bands are considered by many people to be unsightly, weird, and/or distracting.

SUMMARY OF THE INVENTION

Objects of the invention are to provide an improved annular light unit, and to provide a screw-in annular light unit that is compact, and which achieves improved uniformity of illumination on a lamp shade.

The invention comprises, briefly and in a preferred embodiment, an annular light unit having a circular light source, and a plurality of symmetrically arranged light-baffle members extending radially from the central axis of the light source to the circular light source and dimensioned so as to increase the uniformity of illumination from the light unit on a lamp shade when the unit is used in a shade-type of lamp such as a typical floor lamp or table lamp having a translucent shade surrounding the light unit. In one preferred embodiment, the light unit includes a cylindrical hub at the axis of an annular fluorescent lamp, a conventional screw-in lamp base is provided at an end of the hub, and three light-baffle members extend symmetrically radially outwardly from the hub and their outer ends connect with the annular light source so as to support it from the hub. Preferably the hub and light-baffle members are an integral unit of molded or assembled plastic material. In dimensioning the radial baffles to achieve the objective of improving uniformity of illumination on the shade, it is preferred that their widths (in a direction parallel to the axis of the hub and annular lamp) be equal to or slightly greater than the cross-section diameter of the annular lamp. Expressed differently the widths of the baffle members are such that they extend between the parallel planes defined by the upper and lower surfaces of the annular lamp (assuming the lamp's axis to be vertical) or may further extend slightly above and below these planes. In an additional preferred embodiment, the height of the central hub is such that it extends both above and below the radial baffle members.

DESCRIPTION OF THE PREFERRED EMBODIMENT

Figure 1:
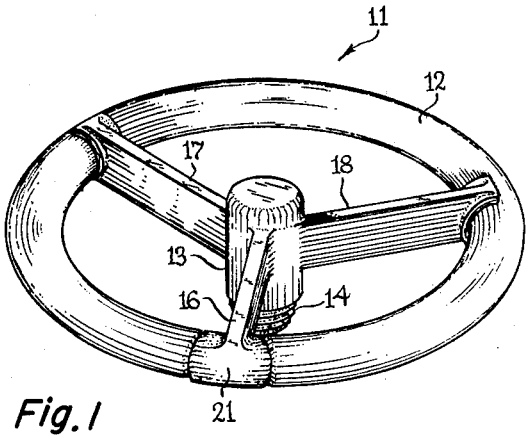
FIG. 1 is a perspective view of a preferred embodiment of the invention.

The circular light unit 11 in FIG. 1 comprises a circular light source 12 such as a "Circline" type of fluorescent light bulb. A cylindrical hub 13 is aligned on the axis of the annular light source 12, and is provided with a threaded screw-base 14 at an end thereof such as to be screwed into conventional lamp sockets. A plurality of light-baffle arm members 16, 17, and 18 are attached to, and extend symmetrically and radially outwardly from, the hub 13 and are attached to, or mechanically engage, the bulb 12 so as to hold and support it in position with respect to the hub 13.

An inductive ballast, or reactor, or an electronic ballast circuit, which is required for proper starting and operation of the fluorescent lamp 12, can be located within the hub 13, or in the base of a lamp in which the unit 11 is to be used, or in a plug-in connector at the end of the lamp's electrical power cord. A connector member 21 is formed integrally with one of the arm members 16 and fills the gap between the ends of the circular light bulb 12. Electrical connector wires, connected to the ballast in the hub 13, or connected to the screwbase 14 if the ballast is external of the light unit 11, may pass through the arm member 16 and into the connector member 21, where they are connected to lead-in wires at the ends of the lamp bulb 12, which lead-in wires are connected to filaments within the lamp, in well-known manner.

Figure 3:
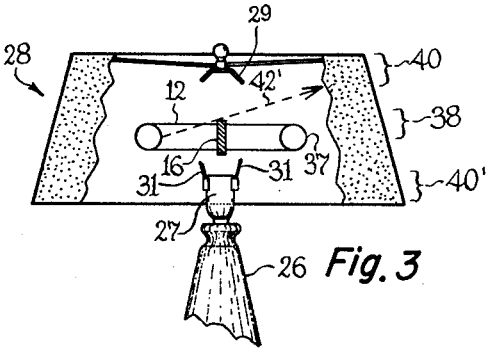

In accordance with the invention, the widths of the light-baffle support arms 16, 17, and 18 (these widths being in the direction parallel to the axis of the hub 13, ie. vertical when the lamp unit is in normal operating position) are such as to cause light from the circular bulb 12 to illuminate a lamp shade with substantially uniform brightness over the surface of the shade. To accomplish this objective, preferably the widths of the light-baffle arms 16, 17, and 18 are at least equal to the cross-section diameter of the tubular bulb which is curved to form the circular lamp 12, and may be wider than the bulb diameter by an amount up to about twice that of the lamp bulb diameter. Preferably the arms 16, 17, and 18 are centered with respect to the circular lamp 12; ie, the tops and bottoms of these arms lie in planes defined by the top and the bottom edges of the annular lamp 12, or extend by equal distances above and below these planes as shown in FIG. 3. Various other numbers of the baffle-arms may be employed instead of the three arms of the preferred embodiment; the arms should be symmetrically arranged around the hub 13.

If the hub 13 does not contain a ballast, this hub may be reduced in size so as to constitute the mutual joinder of the baffle arms. Preferably the thickness of the baffle arms is less than their widths, for the purpose of attractive appearance.

Figure 2:
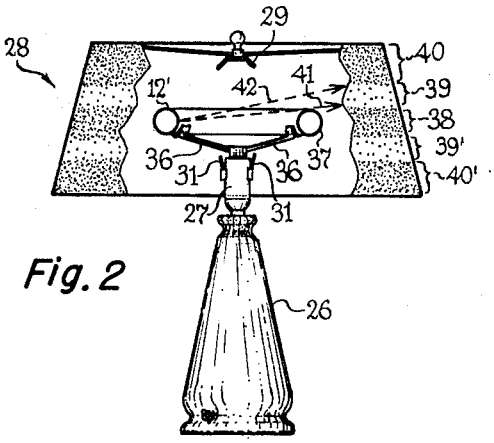
FIGS. 2 and 3 illustrate how the invention functions in a shade-type lamp.

The functioning of the invention will now be explained with reference to FIGS. 2 and 3, each of which shows a table lamp comprising a base 26 carrying a lamp socket 27 at the upper end thereof. A lamp shade 28, of conventional translucent type, is held in the usual position by a conventional harp 29 having lower leg ends 31 attached to the socket 27. The harp 29 is not fully shown, so that the functioning of the invention can be shown more clearly. The shade 28 is partly broken away to reveal the light bulb and some representative light rays. In FIG. 2, a prior art type of circular lamp unit is shown screwed into the lamp base 27 and having a circular lamp 12' supported by slender support arms 36 extending upwardly and outwardly from the screw base. Light from the outer circumference 37 of the lighted bulb 12' illuminates the shade 28 on the inside surface thereof, there being a band 38 of illumination around the circumference of the shade, indicated by stippling in the drawing, of a given brightness and which band 38 is illuminated substantially only by light from the adjacent outer circumference 37 of the bulb 12', because each peripheral portion of the bulb 12' shields the band 38 on the shade 28 from receiving any direct light from the opposite peripheral portion of the bulb 12'. The brightness of the light band 38 is determined primarily by the brightness of the bulb 12', the translucency of the shade 28, and distance between the shade 28 and the outer circumference 37 of the bulb 12'.

Just above the central lighted band 38 on the shade 28, there is a relatively brighter lighted band 39 which is illuminated by light from the bulb 12', adjacent outer circumference 37 almost as brightly as is the band 38, and the band 39 is further illuminated by a wedge of light, indicated by light rays 41 and 42, emanating from the inner surface of the opposite side of the bulb 12'. This additive effect of light is continuous around the circumference of the shade, whereby the band 39 is relatively brighter than the band 38.

Just above the relatively brighter band 39 there is a relatively darker band 40 of illumination, because this band of the shade is relatively farther from all portions of the bulb 12' than is the band 39, and thus the band 40 receives relatively less intensity of illumination than does the band 39. Below the band 38 there is a relatively brighter band 39' and a relatively darker band 40' on and around the shade 28, corresponding to and caused by the reasons given above with respect to the bands 39 and 40. The relatively "darker" bands 38, 40, and 40' are not necessarily of equal brightness but are approximately the same brightness, and within each band the brightness may vary or taper slightly along the vertical width of the band.

As explained above, many people consider the bands of differing brightness on and around the shade, as described with respect to FIG. 2, to be unsightly and objectionable.

The light unit of the invention, of which a preferred embodiment is described above with respect to FIG. 1, functions as follows in providing substantially uniform illumination on the surface of the shade 28. In FIG. 3, only a portion of the light unit 11 is shown, which portion includes a cross-section view of the light-baffle arm member 16. Light from the outer circumference of the bulb 12 illuminates the shade 28, including the band 38 on and around the shade which is illuminated at a brightness level the same as the band 38 in FIG. 2. The light-baffle arm 16 substantially blocks the light ray 41 of FIG. 2 and all other light rays between the rays 41 and 42, thus eliminating the relatively brighter band 39 on the shade 28. The brighter band 39' is similarly eliminated. The light-baffle arms 16 and 17 may be regarded as a single baffle extending substantially across the inside of the bulb 12, and the arms 17 and 18, and 16 and 18 may similarly be regarded as single baffles, all of which function to block light which emanates from an inside portion of the bulb 12 and prevents it from reaching an opposite portion of the shade. The net result is elimination of both of the relative brighter bands 39 and 39', or a reduction of their brightness so that the shade appears to be uniformly illuminated, the illuminated bands 40 and 40' at the top and bottom of the shade having brightness levels similar to that of the center band 38.

Three symmetrically arranged baffle arms, as shown in FIG. 1, adequately cause sufficient uniformity of illumination on the shade, although a greater number of them can be provided if desired. Two such baffle arms, positioned along a diameter across the inside of the bulb 12, would improve the uniformity of shade illumination at opposite sides of the shade. The optimum widths of the baffle arms 16, 17, and 18 for best uniformity of shade illumination depends primarily on the relative diameters of the bulb 12 and shade 28, and can readily be determined by experiment. Light units 11 can be provided in different sizes, having different overall diameters of the bulb 12, for use in lamps having shades of various diameters.

The light unit 11 is installed by removing the harp 29 from the lamp 26, screwing the light unit into the socket 27, and attaching the harp to the lamp by inserting the legs of the harp between baffle arms of the light unit.

The light unit of the invention achieves the objective of illuminating a lamp shade with improved uniformity of brightness, and does so with a construction of the light unit that is relatively uncluttered and has a pleasing appearance.

While preferred embodiments and modifications of the invention have been shown and described, various other embodiments and modifications thereof will become apparent to persons skilled in the art and will fall within the scope of the invention as defined in the following claims.

What I claim as new and desire to secure by United States Letters Patent is:

1. A light unit comprising a circular light source of which the opposed circular edges respectively lie in a pair of spaced apart parallel planes, and three or more individual elongated light baffle members extending radially from the central axis of said circular light source and toward said light source, the widths of said light baffle members being at least as great as the thickness of said circular light source and extending completely between or beyond both planes of said pair of planes such as to cause said light unit when lighted to substantially uniformly illuminate the surface of a shade positioned around said light unit, there being spaces between said elongated light-baffle members through which a lamp harp can pass.

2. A light unit as claimed in claim 1, including a hub positioned on said central axis, and a screw-base attached to an end of said hub.

3. A light unit as claimed in claim 1, in which the outer ends of said light-baffle members are attached to and support said circular light source.

4. A light unit as claimed in claim 1, in which said light-baffle members are arranged symmetrically around said central axis.

5. A light unit as claimed in claim 3, including a connector member positioned in a gap in said circular light source, said connector member being at the outer end of and integral with one of said light-baffle members.

6. A light unit as claimed in claim 3, including a hub positioned on said central axis, and a screw-base attached to an end of said hub.

7. A light unit as claimed in claim 1, in which said widths of the light-baffle members extend approximately equal distances beyond each of said planes.

* * * * *